US008820022B1

(12) United States Patent
Riccobene et al.

(10) Patent No.: US 8,820,022 B1
(45) Date of Patent: Sep. 2, 2014

(54) BUILDING UNIT WITH COBBLE TOP

(71) Applicant: Keystone Retaining Wall Systems LLC, Minneapolis, MN (US)

(72) Inventors: Thomas S. Riccobene, Albuquerque, NM (US); Robert A. MacDonald, Plymoth, NM (US)

(73) Assignee: Keystone Retaining Wall Systems LLC, Minneapolis, MN (US)

( * ) Notice: Subject to any disclaimer, the term of this patent is extended or adjusted under 35 U.S.C. 154(b) by 0 days.

(21) Appl. No.: 13/835,841

(22) Filed: Mar. 15, 2013

(51) Int. Cl.
*E04B 5/04* (2006.01)
*E04F 15/02* (2006.01)
*E04F 13/08* (2006.01)

(52) U.S. Cl.
CPC ..... *E04F 13/0889* (2013.01); *E04F 15/02* (2013.01)
USPC ..... 52/596; 404/34

(58) Field of Classification Search
USPC ..... 52/177, 596, 588.1, 589.1; 404/34, 39
See application file for complete search history.

(56) References Cited

U.S. PATENT DOCUMENTS 3,267,823 A * 8/1966 MacRae ..... 404/41
4,354,773 A * 10/1982 Noack ..... 404/41
4,544,305 A 10/1985 Hair
4,773,790 A * 9/1988 Hagenah ..... 404/41
5,173,003 A 12/1992 Hair
D397,802 S 9/1998 Terry
5,884,445 A * 3/1999 Woolford ..... 52/311.2
5,902,069 A * 5/1999 Barth et al. ..... 404/34
5,921,705 A * 7/1999 Hodson et al. ..... 404/41
5,941,657 A * 8/1999 Banze ..... 404/39
D431,870 S 10/2000 Ziegler, Jr.
D431,871 S 10/2000 Abbrancati
D439,677 S * 3/2001 Mattox ..... D25/113
D442,703 S 5/2001 Fifield
6,471,440 B1 * 10/2002 Scheiwiller ..... 404/39
6,863,469 B2 * 3/2005 Bolduc et al. ..... 404/41
D505,733 S 5/2005 Castonguay et al.
D540,954 S 4/2007 Bouchard
D543,642 S 5/2007 Castonguay et al.
7,220,078 B2 * 5/2007 Drost et al. ..... 404/38
D550,375 S 9/2007 Thomassen et al.
D553,260 S 10/2007 Castonguay et al.
D574,087 S 7/2008 Bouchard
D574,514 S 8/2008 Bouchard (Continued)

OTHER PUBLICATIONS

Lowe's Home Improvement brochure entitled "Add Beauty and Value to Your Home" with Matt Stone, 2003.

*Primary Examiner* — William Gilbert
*Assistant Examiner* — Gisele Ford
(74) *Attorney, Agent, or Firm* — Greer, Burns & Crain, Ltd.

(57) ABSTRACT

A building unit has a substantially planar base having an outer periphery including multiple mating sides. Each mating side has at least one "S"-connection, which includes at least one outwardly extending male mating section and at least one inwardly extending adjacent female section. On the base, there are multiple cobbles or raised regions separated by false joints. A first portion of the raised regions are positioned on the male mating sections, respectively and extend to positions proximate to the outer periphery of the base. A second portion of the raised regions are positioned adjacent the female mating sections, respectively and are set back from the outer periphery. Each side of one unit can mate with any side of another like unit. The arrangement results in a surface covering that lacks a discernible pattern.

17 Claims, 9 Drawing Sheets

(56) References Cited

U.S. PATENT DOCUMENTS

| | | | | |
|---|---|---|---|---|
| D574,515 | S | 8/2008 | Bouchard | |
| D574,516 | S | 8/2008 | Bouchard | |
| D586,925 | S | 2/2009 | Riccobene | |
| D590,070 | S | 4/2009 | Castonguay | |
| D590,071 | S | 4/2009 | Castonguay | |
| D590,072 | S | 4/2009 | Castonguay | |
| D601,267 | S | 9/2009 | Merault | |
| 7,637,688 | B2 * | 12/2009 | Riccobene | 404/41 |
| D624,202 | S | 9/2010 | Thomassen et al. | |
| D624,203 | S * | 9/2010 | Thomassen et al. | D25/113 |
| 7,850,393 | B2 * | 12/2010 | Hamel | 404/36 |
| D661,409 | S * | 6/2012 | Riccobene | D25/113 |
| 8,226,323 | B2 * | 7/2012 | Bouchard et al. | 404/41 |
| 8,298,641 | B2 * | 10/2012 | Riccobene | 428/44 |
| 8,337,116 | B2 * | 12/2012 | Castonguay et al. | 404/41 |
| 8,413,397 | B2 * | 4/2013 | Lacas et al. | 52/311.1 |
| 8,425,146 | B2 * | 4/2013 | Merriam | 404/39 |
| 8,500,361 | B2 * | 8/2013 | Castonguay et al. | 404/34 |
| 2003/0007834 | A1 * | 1/2003 | Bolduc et al. | 404/41 |
| 2007/0077387 | A1 * | 4/2007 | Riccobene | 428/44 |
| 2008/0240857 | A1 * | 10/2008 | Ciccarello | 404/41 |
| 2011/0067333 | A1 * | 3/2011 | Lacas et al. | 52/311.1 |
| 2012/0247050 | A1 * | 10/2012 | Bouchard et al. | 52/578 |

* cited by examiner

BUILDING UNIT WITH COBBLE TOP

FIELD OF THE DISCLOSURE

This disclosure relates to building units forming a surface covering and/or structure, and more specifically relates to stones, bricks, pavers and tiles.

BACKGROUND OF THE DISCLOSURE

Conventional surface coverings are well known, such as walkways, driveways, patios, floors, work surfaces, walls, and other interior or exterior surfaces with stones, bricks, pavers, tiles, and other architectural surface covering units. It is further known to construct walls and other structures with stone and bricks. Natural stone surface coverings and structures are constructed by cutting and fitting irregularly sized and shaped stones. The work requires a skilled stonemason to select, cut and fit the stone. It is labor intensive, and accordingly expensive. Custom built natural stone surfaces and structures, however, are very attractive and desirable.

Also, coverings and structures are constructed of manufactured pavers, bricks, tiles or other similar units. Manufactured units are typically provided in various geometric shapes, such as squares, rectangles and hexagons, etc. Surfaces covered with the manufactured units typically are laid in repeating and easily recognizable patterns. Alternatively, it is known to lay conventional units in random, non-repeating patterns.

Random patterns are regarded as esthetically pleasing and are becoming more popular due to their more natural appearance and non-geometric forms. However, random patterns of manufactured units do not have the degree of natural irregularity that is desirable in custom stone walkways, driveways, patios, walls and the like.

SUMMARY OF THE DISCLOSURE

According to the present disclosure, there is provided a building unit having at least three, preferably four or more mating sides. The building unit includes a substantially planar base having an outer periphery. Each mating side has at least one "S"-connection, which includes at least one male section and at least one adjacent female section. On the base, there are multiple raised regions where a first portion of the raised regions are positioned at male mating sections adjacent to the unit periphery and a second portion of the raised regions are positioned set back from the periphery of the unit at the female mating section.

In another embodiment, a building unit having four sides is provided that includes a substantially planar base, a first mating side, a second mating side disposed on an opposite side of the first mating side, a third mating side disposed generally perpendicularly relative to the first mating side, a fourth mating side disposed on an opposite side of the third mating side, and multiple raised regions on the base. Each mating side has at least one "S"-connection, which includes at least one male mating section and at least one female mating section arranged continuously and alternatively on a periphery of the unit. One or more of the raised regions extend outwardly at one or more male sections of each mating side proximate to the periphery of the unit, and one or more of the raised regions are set back inwardly from the periphery of the unit at one or more female sections of each mating side.

In yet another embodiment, a building unit having a rectangular configuration is provided that includes a substantially planar base, and first and second pairs of mating sides. Each side has at least one "S"-connection, which includes at least one male mating section and at least one female mating section. The unit has a dimension in a longitudinal direction that is longer than the dimension of the unit in a transverse direction. Further, there are multiple cobbles on the base, where a first portion of the cobbles are positioned outwardly closely adjacent to the unit periphery at the male mating sections and a second portion of the cobbles are positioned set back inwardly from the unit periphery at the female mating sections such that the cobbles of the first portion extend outwardly to an outer contour edge of the male mating section that the cobbles of the second portion are set back from an outer contour edge of the female mating section.

The foregoing and other aspects and features of the disclosure will become apparent to those of reasonable skill in the art from the following detailed description, as considered in conjunction with the accompanying drawings.

DETAILED DESCRIPTION OF THE PREFERRED EMBODIMENTS

Preferred embodiments of the present disclosure are described below by way of example only, with reference to the accompanying drawings.

Figure 1:
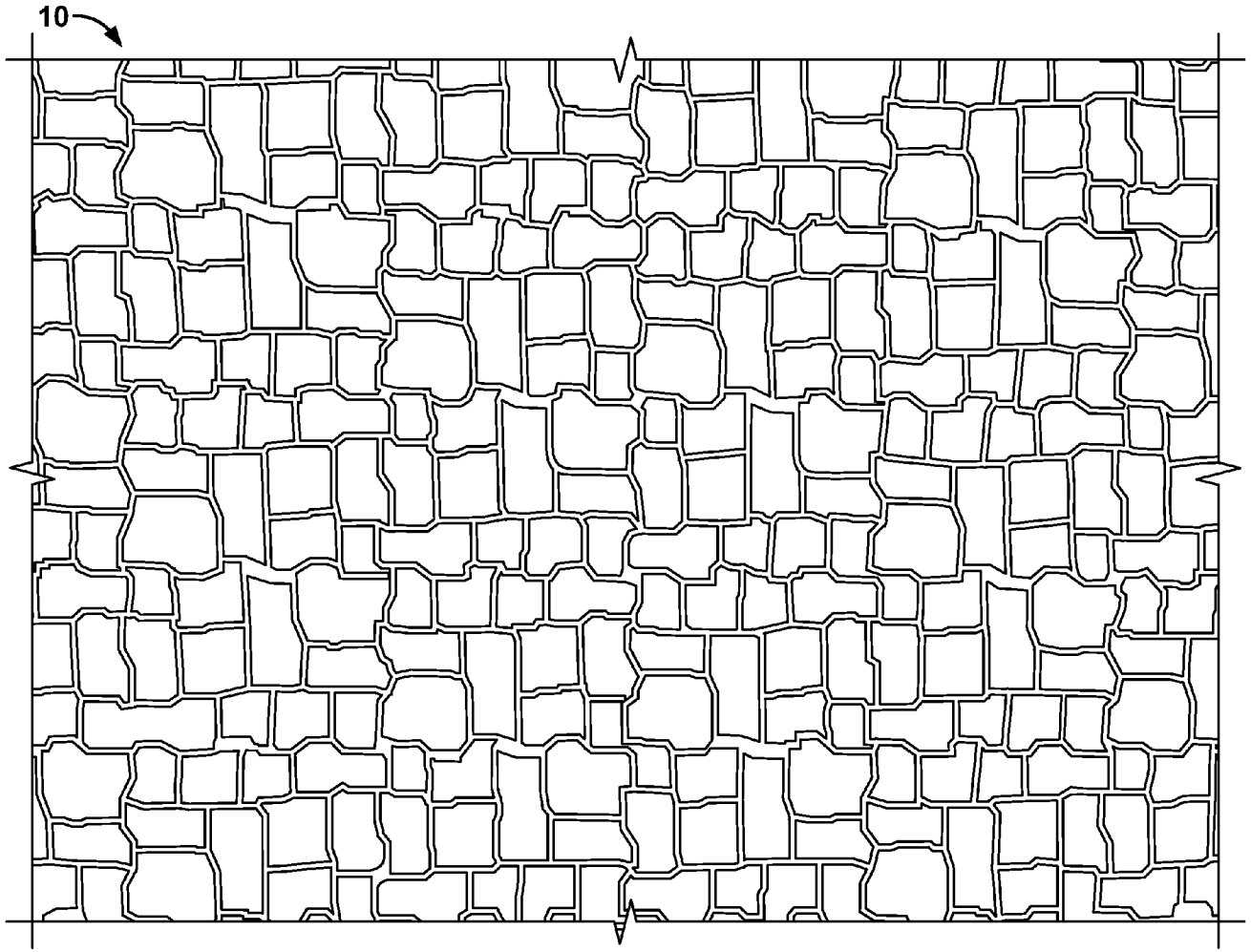
FIG. 1 is a top plan view of an exemplary surface covering assembled with building units in accordance with an embodiment of the present disclosure.

FIG. 1 shows an exemplary surface covering, generally designated 10, constructed in accordance with the present disclosure. Surface covering 10 includes an arrangement of multiple building units without substantial gaps or overlapping. When the units are assembled, the resulting surface has a natural, custom built appearance without any readily apparent repeating pattern. In actuality, the surface of this embodiment is constructed from generally rectangular building units (as described below) arranged in a repeating pattern. However, a pattern is not readily apparent. The surface covering or structure has a natural, non-repeating pattern appearance.

Figure 2:
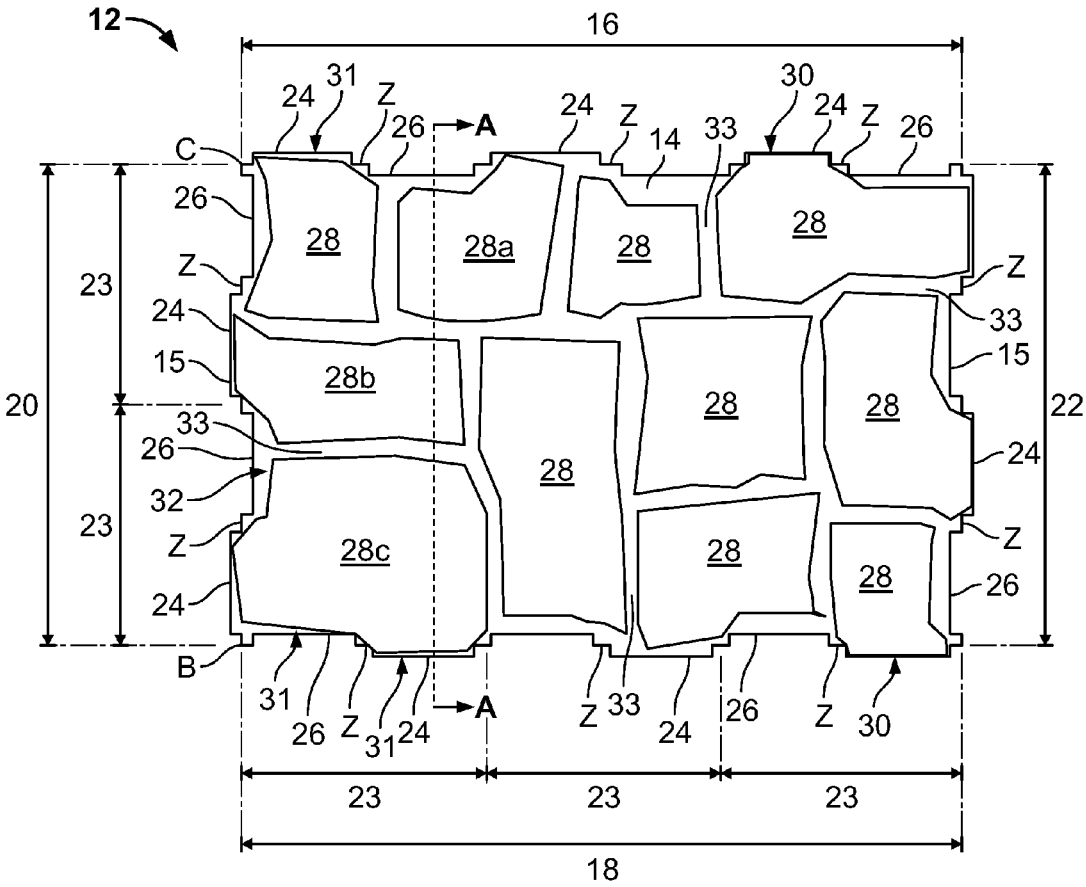
FIG. 2 is an enlarged plan view of the building unit shown in FIG. 1.

FIG. 2 is an enlarged plan view of an embodiment of the building unit 12 used to construct the surface covering 10. The unit 12 has a generally quadrilateral configuration in a plan view. Although a rectangular shape is preferred, as shown in FIG. 2, any polygon with at least three, preferably four or more sides is contemplated. The present embodiment has a substantially planar base 14 with an outer periphery 15 that includes a first mating side 16, a second mating side 18 disposed on an opposite side of the first mating side 16, a third mating side 20 disposed generally perpendicularly relative to the first mating side 16, and a fourth mating side 22 disposed on an opposite side of the third mating side 20.

Figure 3:
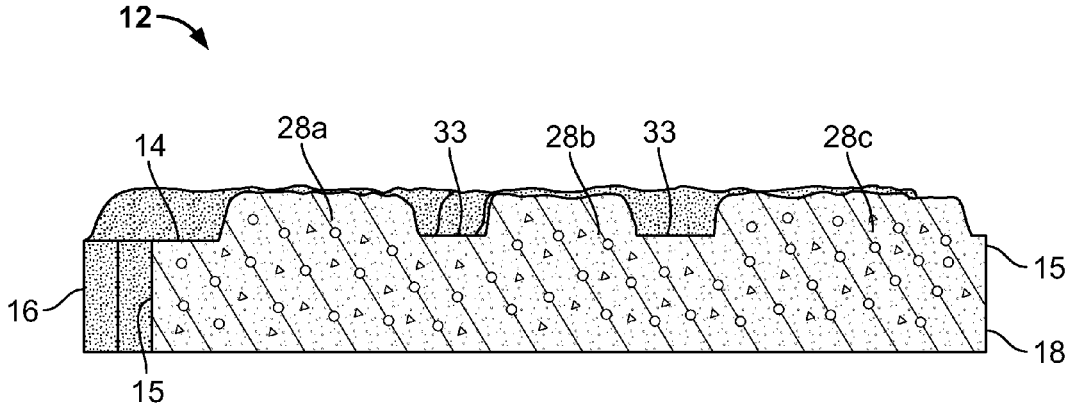
FIG. 3 is a cross-sectional view taken along the line A-A of FIG. 2.

In the embodiment shown in FIGS. 2-3, the unit 12 has a dimension in a longitudinal direction that is longer than the dimension of the unit in a transverse direction; however, the unit dimensions could be the same in both direction. Each side has at least one "S"-connection 23 which includes a generally convex or male mating section 24 and at an adjacent, a generally concave or female mating section 26. In this embodiment, multiple "S"-connections are disposed continuously on the periphery of the unit 12. However, other embodiments may be constructed with one or more non-mating sides, side portions, or corners. Each "S"-connection provides a locking function for holding adjacent units together when assembled, as explained in greater detail below.

In this embodiment, three "S"-connections 23 are disposed of on each of the first and second sides and two "S"-connections are disposed on the third and fourth sides. Each opposing side has the same length, the same number of "S"-connections, and the same mating profiles. Preferably, all of the "S"-connections 23 have substantially the same length and configuration. Accordingly, each side of one unit is capable of mating with any side of another adjacent unit. This feature allows various and multiple ways of assembling the units, examples of which are described below.

Each "S"-connection 23 has a center point Z that bisects the "S"-connection into two sections, each section being a rotational image of the section on the other side of the center point. The length and shape or configuration of the male and female sections are the substantially the same and comprise a 180 degree rotation about the center point Z. Accordingly, each "S"-connection 23 will mate with any other "S"-connection of another like unit. In the embodiment shown in FIGS. 2-3, the "S"-connections have a stepped configuration. However, essentially any configuration can be used including geometric, non-geometric and irregular shapes, provided that the generally convex or male section is a 180 degree rotation of the generally concave or female section. Although straight line segments are preferred for molding purposes, the male and female sections on each side of center point can include smoothly curved or irregular shapes.

As shown in FIGS. 2-3, unit 12 includes multiple raised regions or "cobbles" 28 extending from the base 14. The raised regions 28 preferably have different shapes and configurations to enhance the natural and custom appearance of the surface covering. As shown in FIG. 2, each of the raised regions is angular, having straight line edges in plan view. However, in other or more preferred embodiments, the raised regions are smoothly curved to provide a cobbled surface. The cobbles or raised regions 28 can be regularly shaped, e.g., squares with rounded corners or ovals, or can be irregularly shaped like river stones. Many variations are contemplated to create a natural appearance by employing different shapes of raised regions. Further, the raised regions 28 are separated and surrounded by one or more false joints or grooves 33. Each false joint follows a different line to help disguise an underlying pattern. For example, false joints 33 can vary in shape, width, depth, etc., and thus contribute to a custom stone look.

The natural, non-repeating pattern appearance of surface covering constructed with multiple units 12 is enhanced by selective arrangement of the raised regions 28 relative to the male and female mating sections 24, 26 of the "S"-connections. Specifically, one or more of the raised regions 28 are positioned proximate to the outer periphery 15 at male mating sections 24 and one or more of the raised regions 28 are set back from the outer periphery 15 of the unit adjacent female mating sections 26. By the term "proximate," it means that the raised region(s) 28 extend into or over the convex section 24 of the base to a position that is flush with the outer periphery 15 of the base and/or close to the outer periphery 15. By the term "set back," it means that there is a space between the raised region(s) 28 and the outer periphery 15 of the base, the space preferably having a dimension roughly equivalent to the width(s) of the false joints 33 between raised regions on the unit.

FIG. 3 illustrates the relative contrast between a raised unit 28*a* that is set back from the outer periphery 15 as compared to a raised unit 28*c* that is proximate to the periphery 15. Further, the distances between the raised regions and the periphery can vary. As shown in FIG. 2, in the male sections 24, some of the raised regions 28 are flush with the outer periphery of the unit (e.g., at 30) whereas other raised regions 28 are close to but do not touch the periphery (e.g., at 31). Similarly, the set back dimension between the raised regions 28 adjacent the female sections 26 to the outer periphery 15 varies. For example, the setback distance at 31 is somewhat smaller than the set back distance at 32. Although FIG. 2 shows one or two raised regions 28 extending over each male section 24 to a position adjacent the periphery, it is not required that all of the male section include this feature. Similarly, FIG. 2 shows raised regions set back from the periphery at adjacent female section; however, it is not required that all female sections 25 have this feature.

When assembled, the raised regions 28 at the male sections 24 extend closer to an adjacent mating unit than the raised regions 28 adjacent in the female sections 26. This is the case for both of the adjoining units. Moreover, the spacing width between the raised regions between units varies. According the visible "joint" between mating units at the level of the raised regions is irregular in shape (somewhat serpentine) and has a variable width. The actual joint between units at the base level 14 is hidden. If the joints (both actual and false joints) are filled with sand, grout or other materials, the actual joint at the base level will be concealed and unrecognizable in the constructed surface. As a result, it becomes difficult, if not impossible, to discern the peripheries of individual units, and the surface covering 10 has a non-repeating pattern appearance.

The units of the present disclosure can be provided with irregular surface features, which provide aesthetic benefits. The base, raised regions and sides can be scraped, textured and/or sculpted to facilitate a natural rock-like appearance. To further enhance the natural appearance of surface coverings and structures made with the units, the sides can be molded such that the sides match less than perfectly, i.e., that non-substantial gaps are formed between adjacent units. These gaps can vary in thickness. This is preferably accomplished by introducing minor variations in the sides so that the surfaces are not identical without interfering with mating and interlocks. "Mate" generally refers to fitting or associating suitably. "Interlock" does not necessarily mean that surfaces are touching (though they can be), but refers more generally to the faces having at least two separate points that when shifted a direction parallel to the general direction of the face will contact points along an adjacent face.

To further improve the natural, random appearance of surface coverings it is desirable to provide variations in individual units. The number, shape and arrangement of raised regions can be varied from unit to unit, albeit with the same base. Dyes and colorants may be added to the units, and the color and quantity of dye may be regulated to produce color variations from unit to unit. Surface variations from unit to unit are also desirable. One method of introducing surface variation is to tumble the units after manufacture to roughen or otherwise to provide an aged appearance. An alternative method is to hammer the surface and/or edges of the unit to create small nicks or marks.

Surface variations also may be made in the molds. For example, in a six-form mold assembly, each mold can include a different pattern of raised regions, false joint patterns or other surface irregularities. Thereby, only every sixth unit would be the same. Further, since there can be six different cobble patterns for the mold assembly, each unit can randomly have a different texture on an individual cobble stone.

Figure 4:
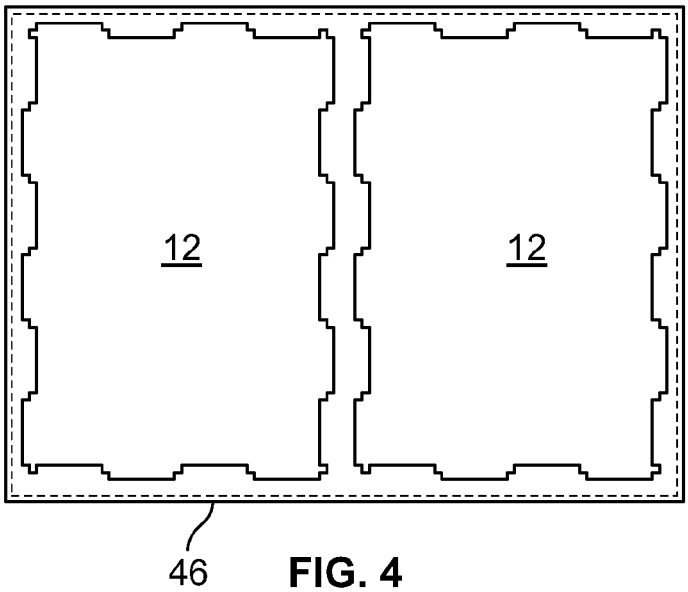
FIG. 4 is an exemplary mold board layout of the building units.

Building units 12 may be molded or otherwise made of concrete, ceramics, plastic, natural or synthetic rubber, glass or other suitable material, or combinations thereof. Concrete is a preferred material for molding paver units in accordance with the present disclosure. There are two conventional concrete molding methods, namely dry cast and wet cast. Dry cast material can be used to mass manufacture low cost units. Wet cast is more expensive, but produces very high quality units. A preferred dry cast method is slip-form molding from dry mix concrete to form units suited for use in walkways, driveways and patios. FIG. 4 shows an exemplary two-form mold layout 46 of the building units 12. The raised regions and false joints on the upper surface of the units are formed with a dry cast molding shoe, as is well known in the industry.

In the wet cast process, the units are molded upside down. The bottom of the form designed to mold the raised regions and false joints that will become the outer or top surface of the unit. An advantage of the wet cast process is that sharper details (e.g., fissures that appear in natural stone) can be replicated, which is difficult to accomplish with other manufacturing methods.

Figure 5:
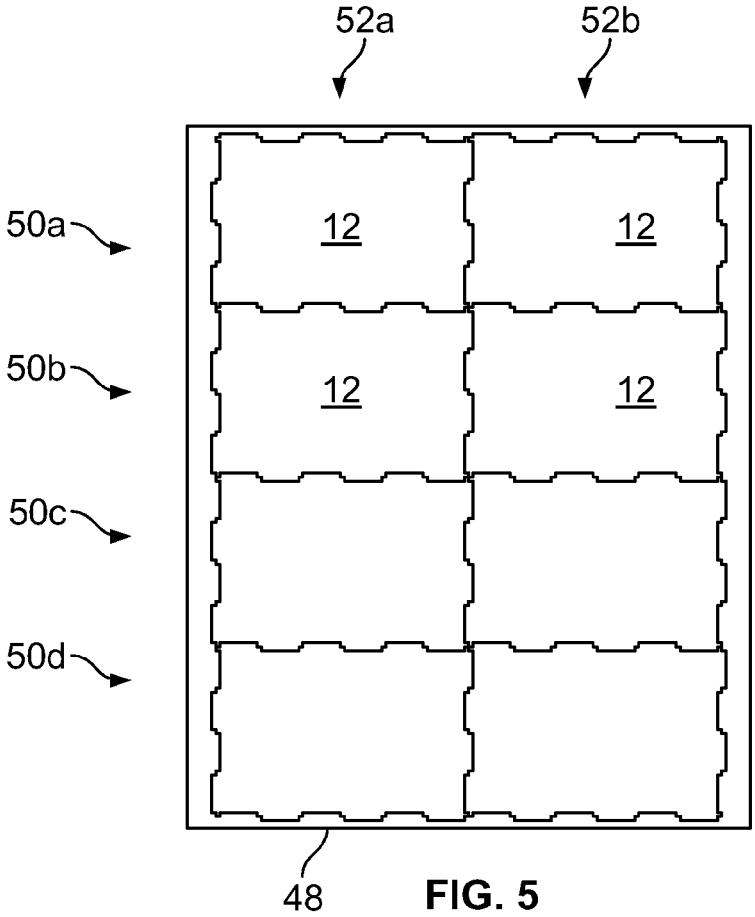
FIG. 5 is an exemplary shipping pallet layout of the building units.

FIG. 5 shows an exemplary shipping pallet layout 48 of the building units 12. Another feature of the "S"-connections is that they provide a locking function for holding adjacent units together not only when assembled in a surface covering, but also during manufacturing, handling and shipping. As discussed above, each mating side will mate with any other mating side. Accordingly, unit in the pallet 48 is interlocked in both a longitudinal 50 and transverse 52 direction.

Figure 6:
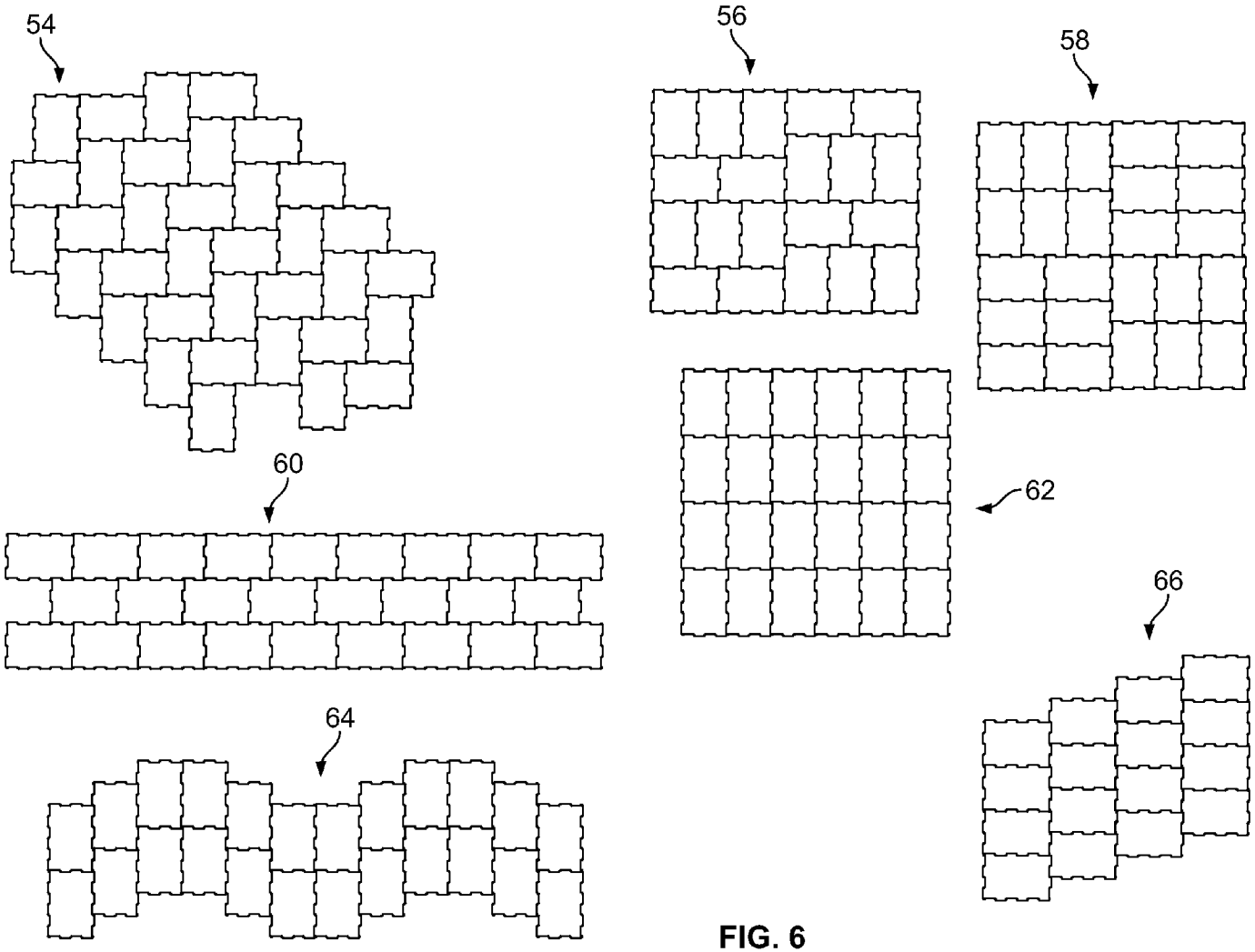
FIG. 6 illustrates exemplary surface covering patterns formed with a multiplicity of the building units of FIG. 2.

FIG. 6 illustrates a few examples of the many possible ways of assembling the building units of this disclosure to form a surface covering. Each unit is configured to mate with other units in essentially any direction or orientation. This feature provides an easy way to assemble the units and a limitless combination of arrangements for professional bricklayers, unskilled tradesmen, and home owners. Partial surface covering 54 illustrates a herringbone layout. The units in partial surface covering 56 are laid to alternate in vertical and horizontal orientation in a basket weave layout. Partial surface covering 58 has a parquet layout. Partial covering 60 has staggered or "1/3 bonded" parallel rows. Partial surface covering 62 has a "stack bond" arrangement. Partial surface coverings 64 and 66 show variations of 1/3 bonded arrangements. Because each unit can be mated with other units in a variety of horizontal and vertical orientations, the orientation of individual cobbles can be varied, which again contributes to the custom look of the surface.

Figure 7A:
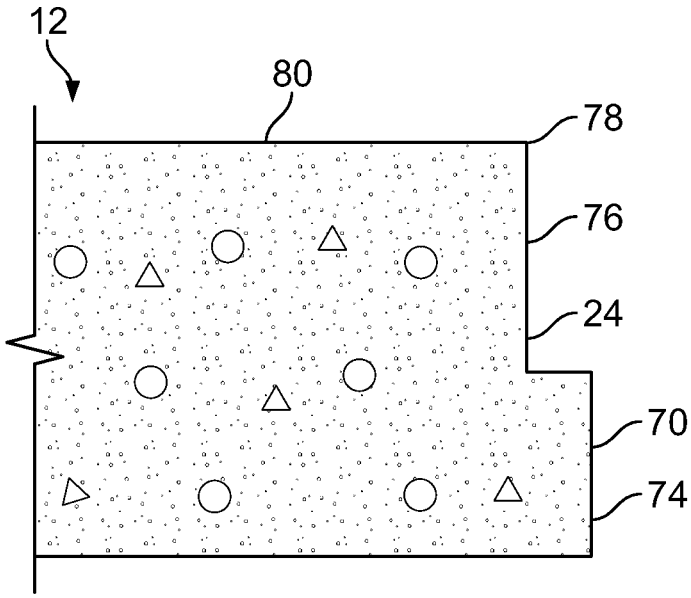
FIGS. 7A-B illustrate exemplary spacers in a partial cross-sectional view taken along the line A-A of FIG. 2.
Figure 7B:
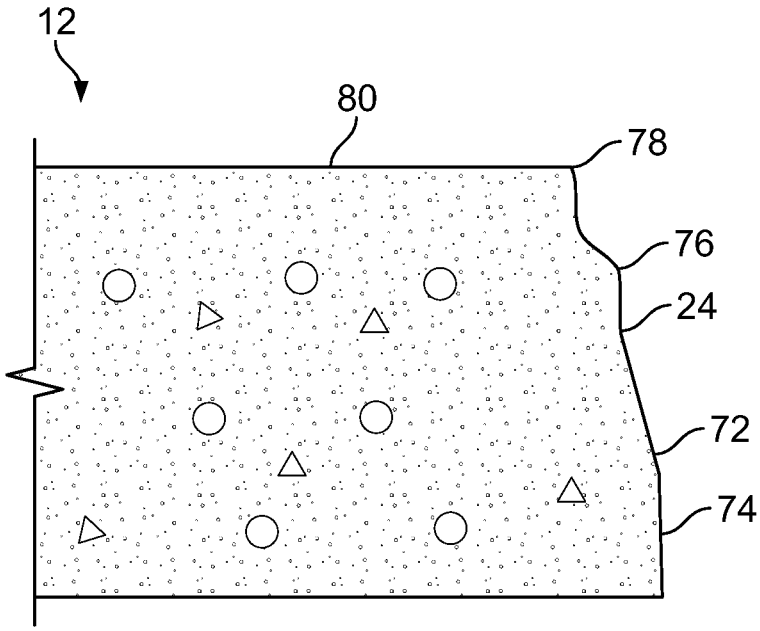

FIGS. 7A-B illustrate that the sides of the unit 12 may be provided with one or more optional spacers 70, 72, as disclosed for example in U.S. Pat. No. 7,393,155, which is hereby incorporated by reference. The spacers 70, 72 of each unit engage adjacent units and maintain the integrity of the layout pattern. As shown in FIG. 7A, spacer 70 is preferably located on a lower portion 74 of the side, indented from the top surface 80, and thus are not visible in the completed surface or structure. Alternatively, as shown in FIG. 7B, the unit sides can be drafted, i.e., an upper portion 76 of the unit side is pulled inwardly relative to the lower portion 74 of the side. In either case, the upper visible side edge 78 of the unit can be spaced inwardly somewhat relative to mating portion of the side to form a gap between assembled units. The spacing of the upper visible edge 78 relative to the lower mating portion 74 of the side (or spacer) may vary such that the width of the visible gap between units varies from place to place. Variable gap width further promotes a natural, custom appearance. Optionally, the transition between the lower and upper portions 74, 76 of the sides can be sculpted to appear rock-like.

Figure 8:
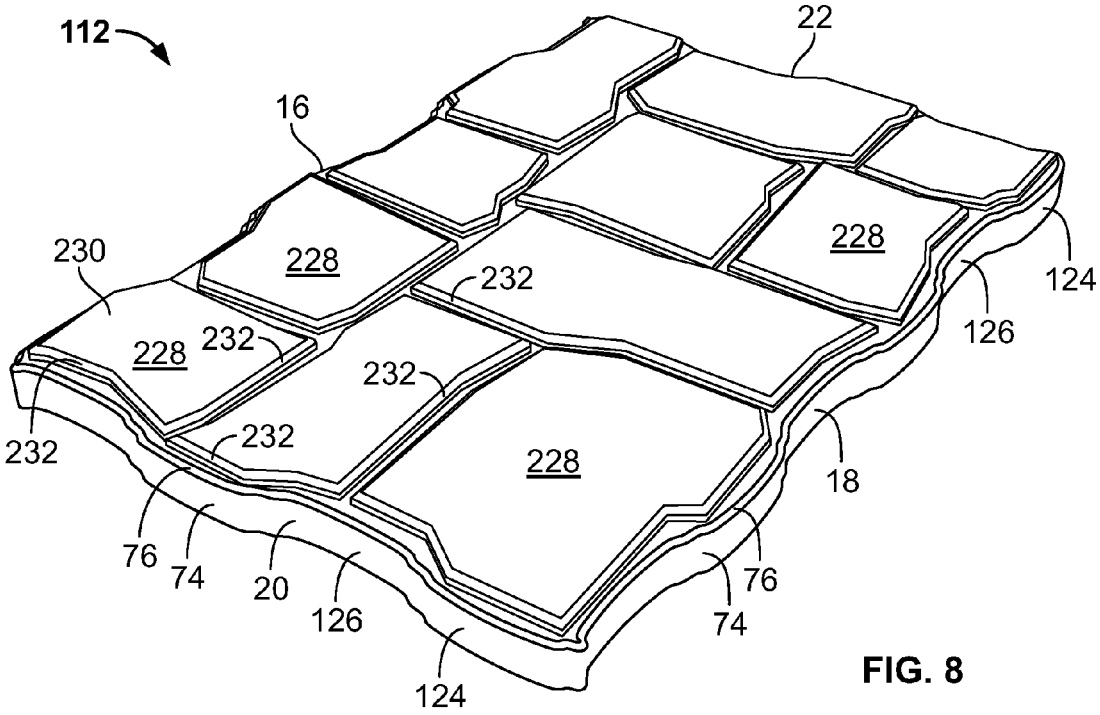
FIG. 8 is a perspective view of another embodiment of the building unit.
Figure 9:
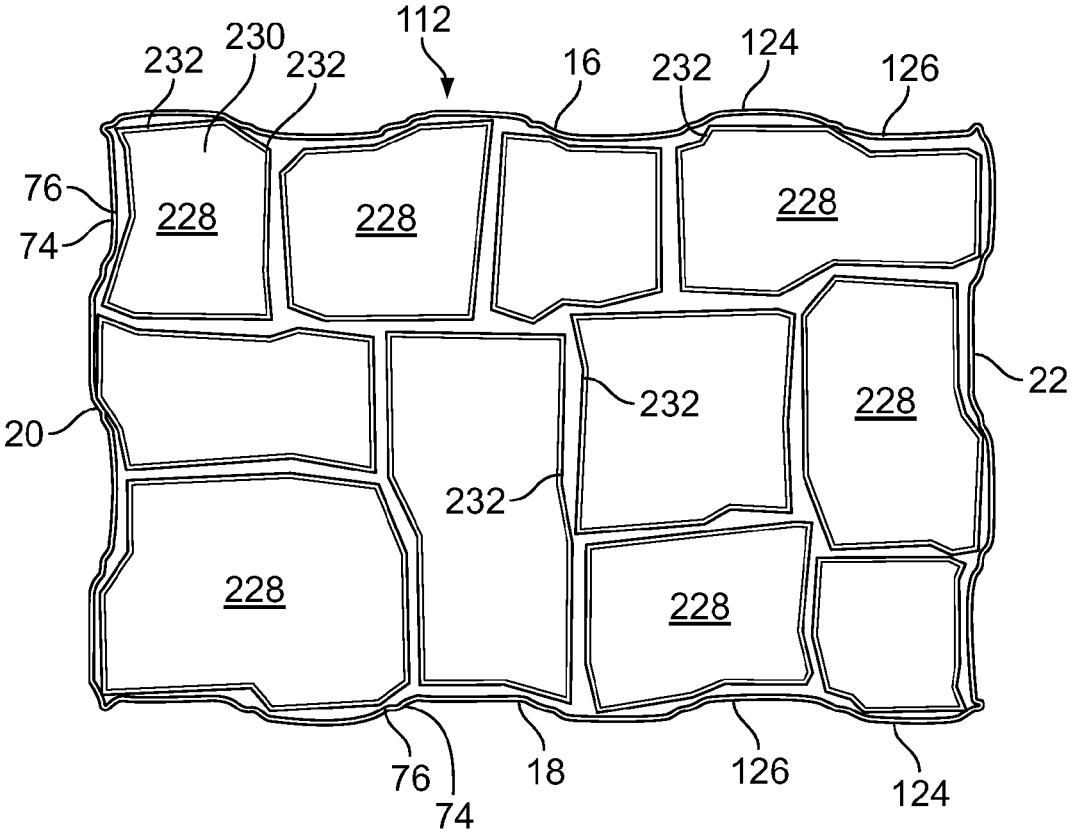
FIG. 9 is a top plan view of the building unit shown in FIG. 8.

FIGS. 8-9 show another embodiment of the building unit 12, generally designated 112. Unit 112 is consistent in many respects to the unit 12 discussed above, and includes many features that are shared with unit 12. For this reason, elements and features that are shared with the unit 12 have been given similar element numbers in the 100 series for clarity. In unit 112 the "S"-connections have smoothly curved or irregular shapes for male and female sections 124, 126 on the periphery of the unit 112, as contrasted from the stepped configuration in unit 12. However, each mating side of the unit 112 maintains substantially the same profile for mating with each corresponding mating side of adjacent units. Further, as shown in FIG. 7B, the upper portion 76 of the unit side is pulled inwardly relative to the lower portion 74 of the side. Raised regions 228 in unit 112 have different shapes and configurations than the raised regions in unit 12. An upper surface 230 meets with tapered sides 232 that are gradually widening from the top to the bottom.

Figure 10:
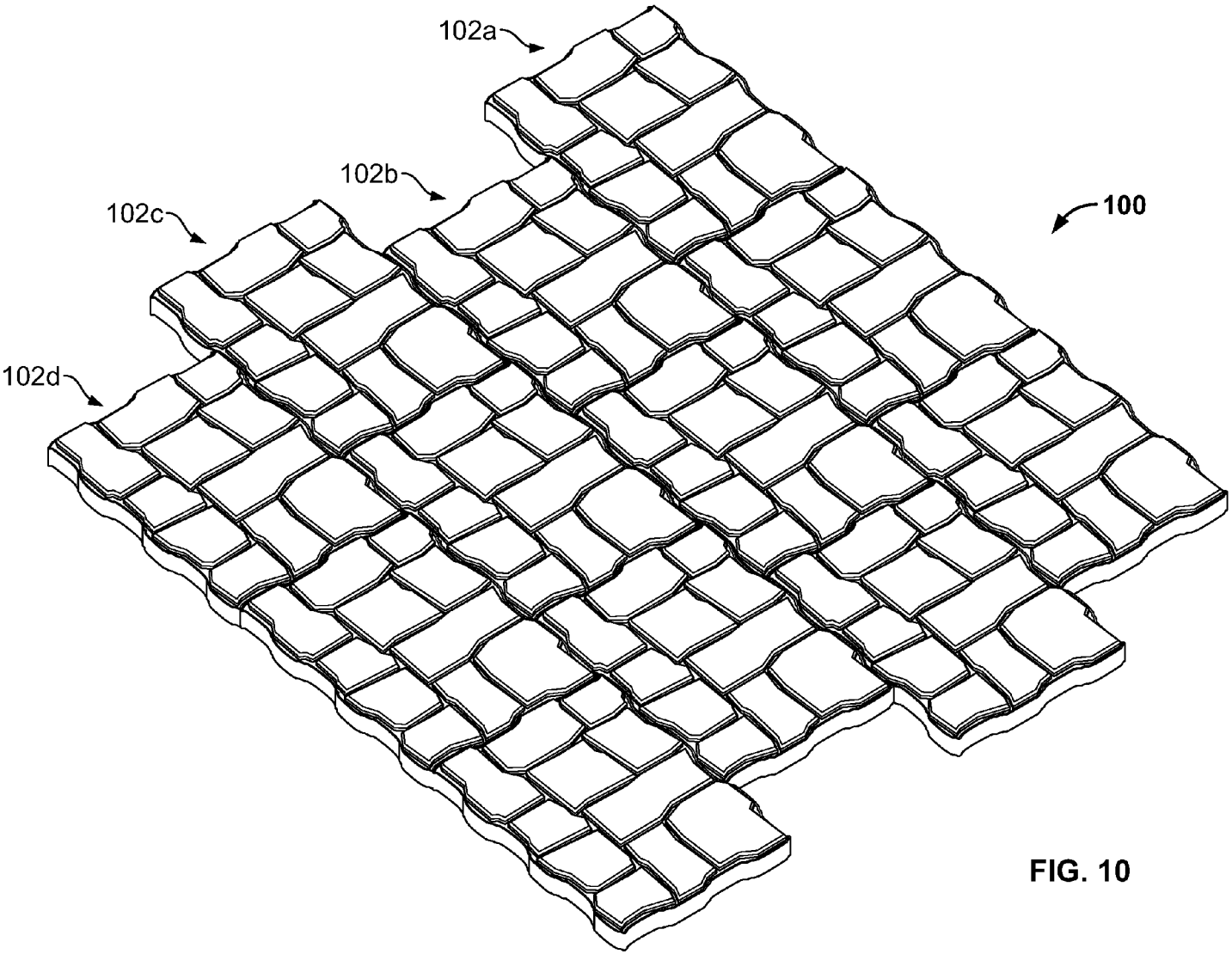
FIG. 10 is a perspective view of an exemplary partial surface covering pattern formed with a multiplicity of the building units of FIG. 8.
Figure 11:
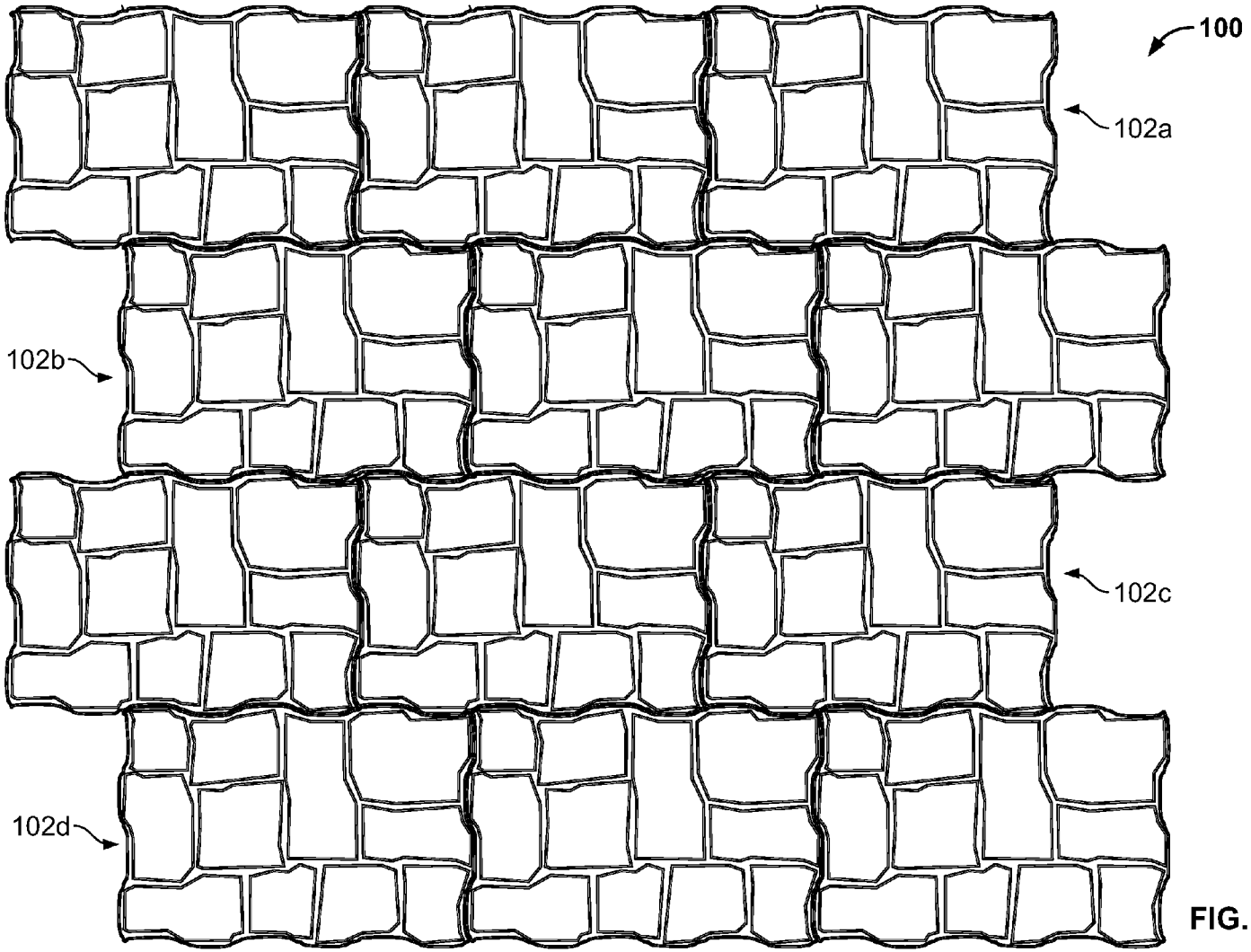
FIG. 11 is a top plan view of the partial surface covering pattern shown in FIG. 10.

FIGS. 10-11 illustrate one example of the many possible ways of assembling the building units 112 to form a partial surface covering 100. Each unit 112 is configured to mate with other units in essentially any direction or orientation. Partial covering 100 has staggered or "1/3 bonded" parallel rows 102. Although only the staggered-row covering is shown, other types and configurations of covering patterns are also contemplated as explained above in reference to FIG. 6.

While preferred embodiments of the disclosure have been herein illustrated and described, it is to be appreciated that certain changes, rearrangements and modifications may be made therein without departing from the scope of the disclosure as defined by the appended claims.

What is claimed is:

1. A building unit for forming a surface covering comprising, a substantially planar base having a main body portion and having an outer periphery and at least three mating sides, wherein each mating side has at least one "S"-connection, each "S"-connection including at least one male section extending outwardly away from the main body portion and at least one adjacent female section extending inwardly toward the main body portion; and a plurality of artificial stones, including perimeter artificial stones located at the outer periphery, separated by one or more false joints on said base, wherein a first portion of each of the perimeter artificial stones is positioned proximate to said outer periphery adjacent said male mating sections, respectively, and a second portion of each of the perimeter artificial stones is positioned a set back distance from the outer periphery adjacent to a said female sections, respectively, wherein the distance between the artificial stones and the outer periphery, varies and the proximate distance to the outer periphery, relative to the male sections is generally smaller than the set back distance relative to the female sections.

2. The building unit of claim 1 wherein said unit has a first and second mating sides disposed opposite one another, and third a fourth mating sides disposed opposite one another and generally perpendicularly relative to said first and second mating sides.

3. The building unit of claim 1, wherein said "S"-connections are substantial images of each other and are configured such that any mating side of one said unit mates with any mating side of another like said unit.

4. The building unit of claim 1, wherein each said "S"-connection has a center point between the male and female sections, each said section being a 180 degree rotational image of the section on the other side of the center point.

5. The building unit of claim 1, wherein said "S"-connections are disposed substantially continuously, end-to-end on said periphery of said unit.

6. A surface covering comprising multiple building units of claim 1 assembled together.

7. A building unit, said unit comprising:

a substantially planar base having a main body portion and having an outer periphery including at least two pairs of mating sides, the sides in each pair being opposed to each other, wherein each mating side has at least one "S"-connection, said "S"-connection including at least one male mating section extending outwardly away from the main body portion and at least one female mating section extending inwardly toward the main body portion, a plurality of artificial stones on said base, including perimeter artificial stones located at the outer periphery, said artificial stones being separated by one or more false joints, wherein a first portion of each of the perimeter artificial stones is positioned, respectively, at said male sections and extend outwardly proximate to said outer periphery, wherein another portion of each of the perimeter artificial stones is positioned, respectively, a set back distance from the outer periphery adjacent to said female sections, and wherein a distance between said perimeter artificial stones and said outer periphery varies, the distance being greater at a majority of said female sections as compared to a majority of said male sections.

8. The building unit of claim 7, wherein each artificial stone has a different shape from the other artificial stones, said unit further comprises irregularly shaped false joints between said artificial stones.

9. The building unit of claim 7, wherein all of said "S"-connections have the same length and configuration.

10. The building unit of claim 9, wherein at least one of said first portion of artificial stones positioned at a male mating section is at least partially flush with said outer periphery.

11. The building unit of claim 7, wherein one pair of sides each has three "S"-connections and the other pair of sides each has two "S"-connections.

12. The building unit of claim 7, wherein at least one of said artificial stones extends over each said outwardly extending male sections.

13. The building unit of claim 7, wherein at least one of said artificial stones positioned adjacent each said inwardly extending female sections and set back from said outer periphery.

14. A building unit comprising a substantially rectangular base having a main body portion and having an outer periphery of first and second pairs of opposed mating sides, each said side having at least one "S"-connection, each said "S"-connection having the same length and configuration, each "S"-connection including a generally convex mating section extending outwardly away from the main body portion and a generally concave mating section that is a rotational image of the convex section extending inwardly toward the main body portion;

wherein said unit has a dimension in a longitudinal direction that is longer than the dimension of said unit in a transverse direction;

a plurality of raised cobbles on said base, including perimeter raised cobbles located at the outer periphery, wherein a first portion of each of the raised perimeter cobbles extends over respective convex mating sections to a position proximate to the outer periphery of said base; and wherein a second portion of each of the raised perimeter cobbles on said base is set back inwardly from the outer periphery of said base adjacent respective concave mating sections, wherein the plurality of raised cobbles are separated by one or more irregularly shaped false joints, and wherein substantially all of said first portion of raised perimeter cobbles is positioned closer to the outer periphery of said base than substantially all of said second portion of raised perimeter cobbles.

15. The building unit of claim 14, wherein at least one of said plurality of cobbles extends over each said convex sections, and wherein at least one of said plurality of cobbles is positioned adjacent each said concave sections and set back from said outer periphery.

16. A surface covering comprising multiple building units of claim 14 assembled to cover a surface without substantial gaps or overlap between adjoining units.

17. The surface covering of claim 16 wherein said building units are orientated in different directions relative to each other.

* * * * *

UNITED STATES PATENT AND TRADEMARK OFFICE

CERTIFICATE OF CORRECTION

PATENT NO. : 8,820,022 B1
APPLICATION NO. : 13/835841
DATED : September 2, 2014
INVENTOR(S) : Thomas S. Riccobene et al.

It is certified that error appears in the above-identified patent and that said Letters Patent is hereby corrected as shown below:

On the Title Page:

In item (72), line 3 please delete "NM" and insert --MN--.

In the Claims:

In column 7, line 6 of the issued patent, after "third" please delete "a" and insert --and--.

In column 8, line 11 of the issued patent, after "stones" please insert --is--.

Signed and Sealed this
Thirtieth Day of June, 2015

Michelle K. Lee

Michelle K. Lee
*Director of the United States Patent and Trademark Office*